US006486836B1

(12) United States Patent
Hill

(10) Patent No.: US 6,486,836 B1
(45) Date of Patent: Nov. 26, 2002

(54) HANDHELD WIRELESS COMMUNICATION DEVICE HAVING ANTENNA WITH PARASITIC ELEMENT EXHIBITING MULTIPLE POLARIZATION

(75) Inventor: Robert Hill, Salinas, CA (US)

(73) Assignee: Tyco Electronics Logistics AG (CH)

( * ) Notice: Subject to any disclaimer, the term of this patent is extended or adjusted under 35 U.S.C. 154(b) by 0 days.

(21) Appl. No.: 09/803,383

(22) Filed: Mar. 8, 2001

Related U.S. Application Data

(60) Provisional application No. 60/188,604, filed on Mar. 9, 2000.

(51) Int. Cl.[7] ..... H01Q 1/38
(52) U.S. Cl. ..... 343/702; 343/795; 343/793
(58) Field of Search ..... 343/702, 700 MS, 343/795, 803, 815, 834

(56) References Cited

U.S. PATENT DOCUMENTS 6,046,703 A * 4/2000 Wang et al. ..... 343/795
6,239,765 B1 * 5/2001 Johnson et al. ..... 343/795

* cited by examiner

*Primary Examiner*—Don Wong
*Assistant Examiner*—James Clinger
(74) *Attorney, Agent, or Firm*—Fulbright & Jaworski L.L.P.

(57) ABSTRACT

A hand held wireless device, such as hand-held data device or cellular telephone, has a simple internal or partly internal antenna system. The antenna system consists of an essentially internal or partly internal asymmetrical dipole with quarter-wave resonator section and radiating planar section, in conjunction with a planar parasitic element closely spaced to the asymmetrical dipole. The radiating planar section may be the ground traces of the HHWCDs printed wiring board PWB.

18 Claims, 6 Drawing Sheets

HANDHELD WIRELESS COMMUNICATION DEVICE HAVING ANTENNA WITH PARASITIC ELEMENT EXHIBITING MULTIPLE POLARIZATION

CROSS-REFERENCE TO RELATED APPLICATIONS

This application claims priority of U.S. Provisional Patent Application S.N. 60/188,604, of Robert Hill, filed Mar. 9, 2000.

FIELD OF THE INVENTION

The invention relates to hand-held wireless communication devices (HHWCDs), such as hand-held data devices, cellular telephones, and the like, having an antenna. In particular, the invention relates to such devices having an antenna system, the antenna system including a parasitic element. The antenna system can be internal or partially internal to the device. The HHWCDs having antennas according to the present invention may be used for transmitting, receiving or for transmitting and receiving.

DESCRIPTION OF RELATED ART

Dipoles, both symmetric and asymmetric, monopoles, and slot antennas provide linear polarization and a doughnut antenna pattern in free space.

Crossed dipoles or slots, referred to as a turnstile antenna, produce circular polarization and near-hemispherical antenna pattern.

Helices provide circular polarization and directivity. Quadrifilar helices provide circular polarization, and near-hemispherical antenna pattern.

Patch antennas provide hemispherical antenna pattern and circular polarization.

Arrays of monopole, dipole, or loop elements provide directivity and linear polarization.

SUMMARY OF THE INVENTION

A principal object of the invention is to control the antenna radiation pattern of a HHWCD antenna.

A related object of the invention is to control the antenna radiation pattern of a HHWCD antenna without increasing the size of the HHWCD.

Another object, applicable only to some of the described embodiments, is to provide a simple low-cost internal antenna system for HHWCDs, suitable for high volume manufacturing and eliminating the susceptibility to damage of external antennas.

Another objective of the invention is to use the existing printed wiring board (PWB) or printed circuit board (PCB) of a HHWCD as part of an internal or partly internal antenna system.

According to the teachings of the present invention, HHWCDs have an antenna system comprising an asymmetrical dipole driven element with a planar resonator element or section and a planar radiating element or section, in conjunction with a thin planar parasitic element closely spaced to the driven element, particularly the planar radiating section thereof The radiating planar section may be the ground traces of the HHWCD's printed wiring board (PWB). The resonator element may be planar and configured as a meandering or serpentine conductor in order to save space and allow the antenna to be totally internal within the device. Such a resonator has negligible radiation because of its configuration. Alternatively, the resonator need not be planar and need not be internal. The resonator may be, for example, an essentially quarter-wavelength straight or coiled wire, mounted externally or an essentially quarter-wavelength planar inverted-F. In the case of an internal planar meandering or serpentine conductor, the resonator's conductor may be the conductive printed wiring trace on a PWB dielectric, a metal stamping, or the like.

In accordance with the present invention, a hand held wireless communications device comprises an enclosure for the device and an antenna, at least partly within the enclosure. The antenna operates within a frequency band and includes a driven element and a thin planar parasitic element. The parasitic element has a generally square configuration wherein the major dimensions of the parasitic element are about a half wavelength within the frequency band. The parasitic element is spaced from the driven element by 0.01 to 0.1 wavelength within the frequency band.

The antenna has dual polarization in some directions and three polarizations in some directions.

The peak gain of a classic dipole antenna or array of dipoles is in a direction perpendicular to the long axis of the dipole. The peak gain of the antenna of the HHWCD of the present invention is nearly normal to the fed dipole axis in one plane and is in one direction, at approximately 195 degrees, as shown in FIG. 5 (described further below). In another plane, the peak gain occurs at angles of approximately 45 and 70 degrees away from the direction perpendicular to the dipole's major axis as shown in FIGS. 2 and 3 (described further below). As will be understood more fully in connection with the antenna patterns described below, this antenna exhibits maximum forward gain on the order of +3 dBi and maximum front-to-back ratio on the order of 7 dB. The antenna demonstrates the characteristic of having two orthogonal polarizations that may combine to result in circular polarization.

The pattern of the antenna is thought to be a result of the placement, size, and design of the asymmetric dipole and the parasitic plate conductor. The front-to-back directivity can be utilized to reduce energy in the direction of a user of the HHWCD, while increasing energy in the opposite direction. The polarization diversity minimizes fading caused by multipath, a common problem with HHWCDs.

DESCRIPTION OF THE PREFERRED EMBODIMENTS

Figure 1A:
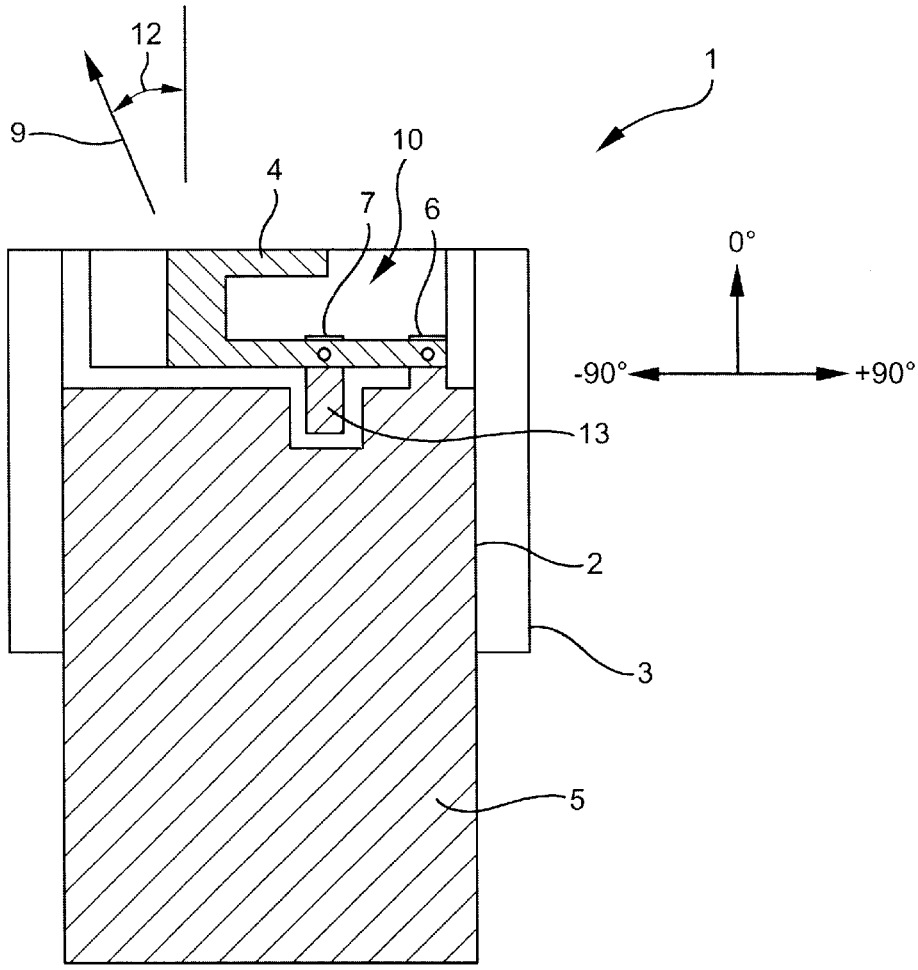
FIG. 1A is an idealized plan view of one embodiment of the antenna system according to the present invention. The figure is not to scale.
Figure 1B:
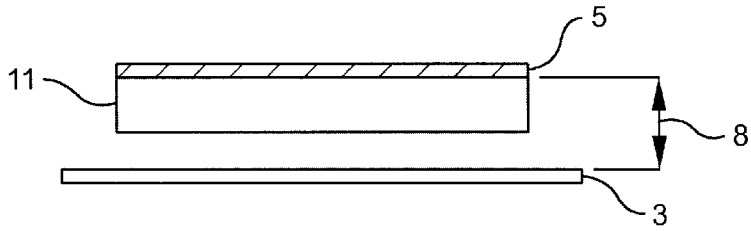
FIG. 1B is an end elevation view of the antenna of FIG. 1A.

Referring to FIGS. 1A and 1B, a plan view and end elevation view of one embodiment of a HHWCD 9 is shown with an essentially internal antenna system according to the present invention. The antenna system includes a planar resonator 10, which may be formed by traces 4 on a dielectric 11, having an electrical length of about one-quarter wavelength in a frequency band, a planar radiating conductor 5, which may be the ground traces on the dielectric substrate 11 and a rectangular planar parasitic element 3. A conventional plastic case (not shown) provides a housing for the HHWCD. Parasitic element 3 may be a thin metal layer such as a foil tape, a plating, or a deposited metal attached to the plastic HHWCD housing. Inasmuch as the foil tape, plating or metal deposit can be on an external surface of the HHWCD, this embodiment is referred to as "essentially internal.

Elements 10 and 5 constitute an asymmetric dipole driven element 2. Driven element 2 is shown spaced a distance 8 from the rectangular parasitic conductor 3. A preferred shape for conductor 3 is square and a preferred size for conductor 3 is at least 0.5 wavelength in each major direction. A preferred value for separation 8 is 0.05 wavelength, although it may range from 0.01 to 0.1 wavelengths and still obtain some of the benefits of the invention.

Resonator 10 may be any configuration that results in substantially no radiation from itself while providing the required operating bandwidth. A preferred embodiment of the asymmetric dipole 2 has a quarter-wavelength resonator 10 that has a serpentine conducting trace 4 on a dielectric 11. Alternatively, resonator 10 may formed of a coiled or helical wire.

Additionally, dielectric 11 has a conductor 5 on one surface, which may be provided by the ground traces of the PWB of a HHWCD. Connection 6 electrically connects conductor 5 and trace 4, and connection 7 electrically connects trace 4 with the 50 ohm feed port of the HHWCD antenna via microstrip line 13. Peak radiation from the antenna so formed is in direction 9 (in the plane of the conductor 5). The plane of the trace 4 may be, but need not be, in the same plane as the plane of conductor 5. Trace 4 may be perpendicular or at some lesser angle to conductor 5.

Figure 1C:
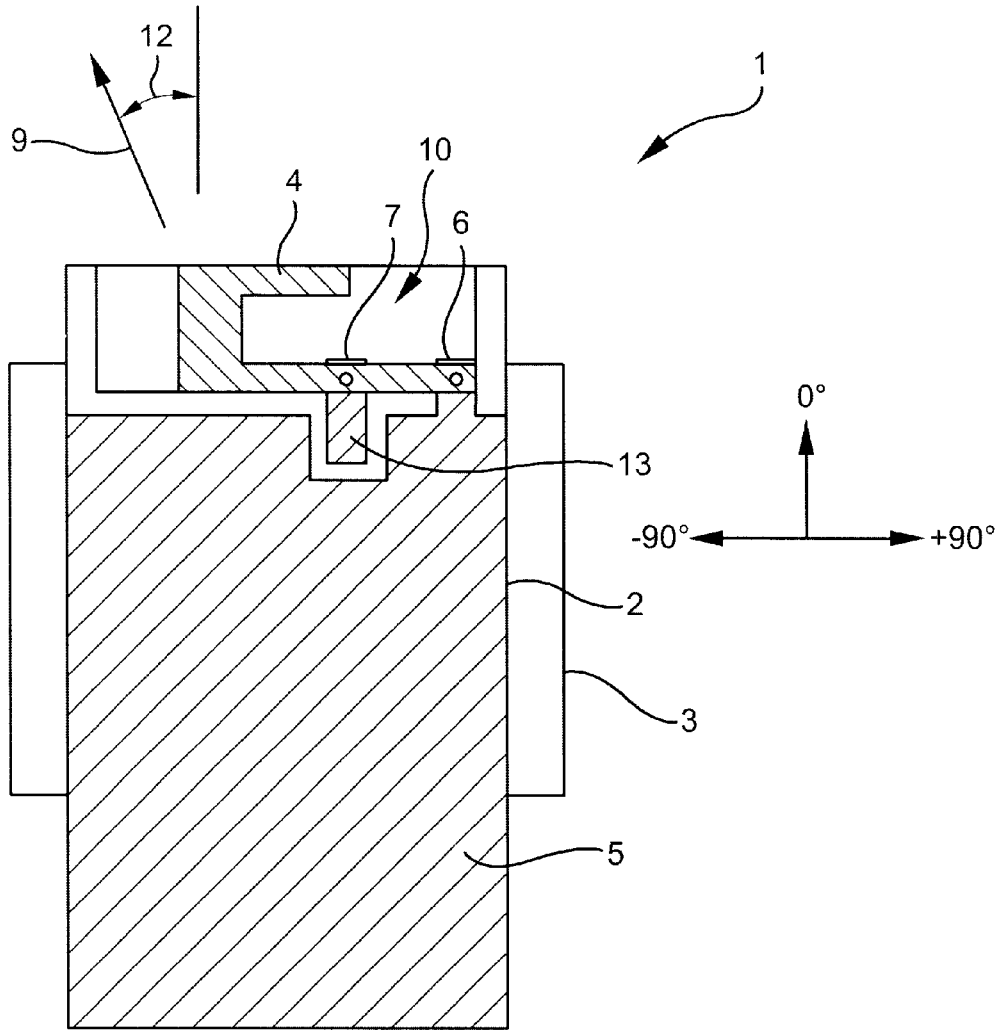
FIG. 1C is an idealized plan view of an alternative embodiment of the antenna system of FIG. 1. The figure is not to scale.

FIG. 1C shows an alternative embodiment of the antenna system of FIGS. 1A and 1B. In this alternative embodiment, the location of the rectangular conductor 3 is shifted laterally with respect to the asymmetric dipole 2. It has been found that the precise location of conductor 3 with respect to the dipole 2 is not critical, although it does affect the system's peak gain value. It is believed that the centerline of conductor 3 should generally be located above the centerline of conductor 5 (as viewed in FIG. 1C).

For convenience in presentation, conductor 5 is shown as a continuous conductor in FIGS. 1A, 1B and 1C; however, in practice it may be array of conductors as is typical of the ground traces of an HHWCD.

Figure 2:
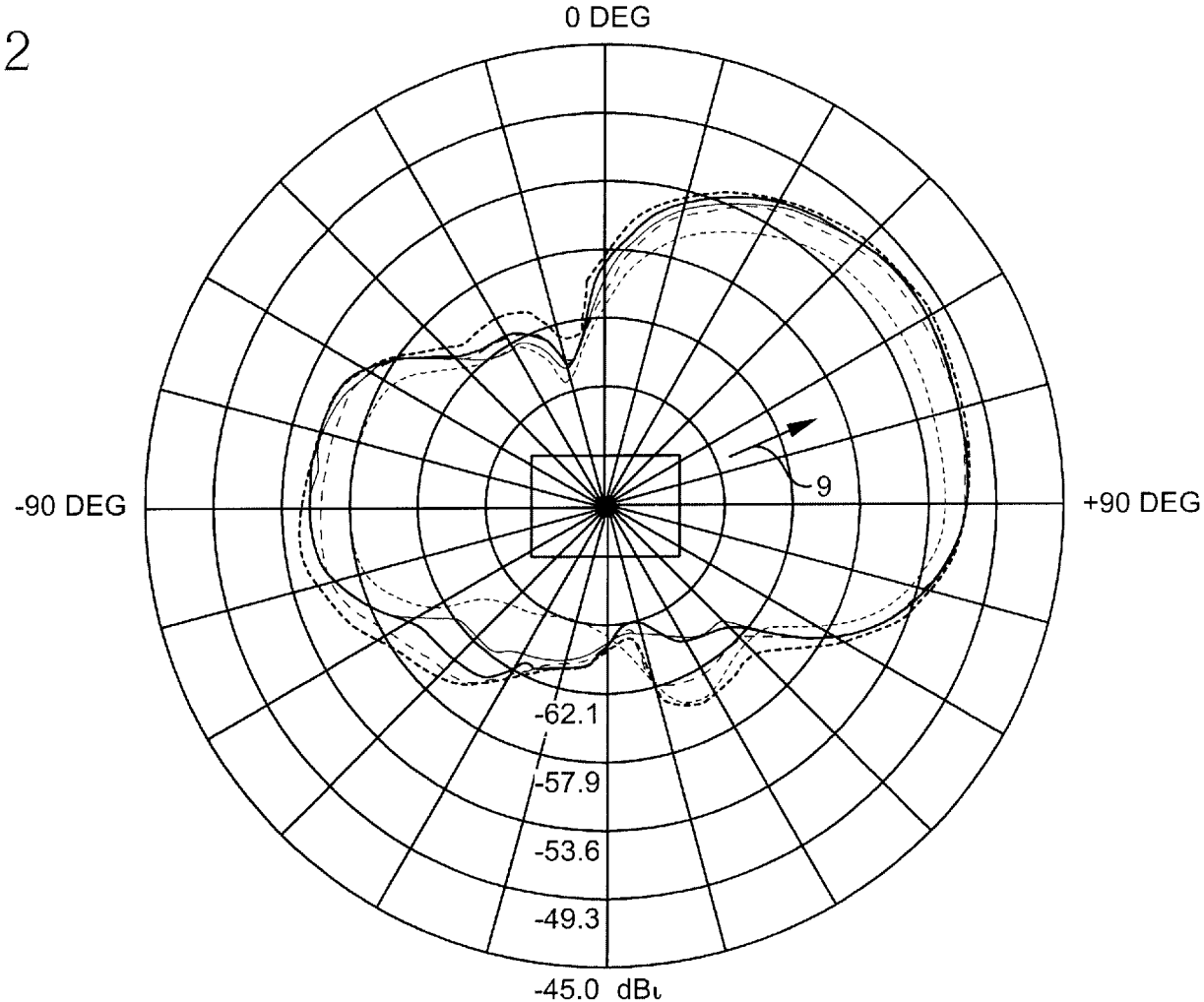
FIG. 2 shows the azimuth antenna pattern of a practical embodiment of the antenna system for horizontal polarization, over one range of frequencies. The plane of rotation is that of the paper.

Referring to FIG. 2, the horizontally polarized azimuth antenna pattern of a practical embodiment of the antenna of the present invention for certain frequencies in the range of 2.4–2.5 GHz is shown. Reference dipole gain of +2 dBi is at the −51 dBi level on this plot, thus gain of the present antenna is +3 dBi maximum in direction 9 at an angle 12 (see FIG. 1A) of 40 degrees. Front-to-back ratio is seen to be 4 dB nominal from the plot. The image at the center of the polar plot is an icon representing the parasitic element located above the radiating portion of the driven element.

Figure 3:
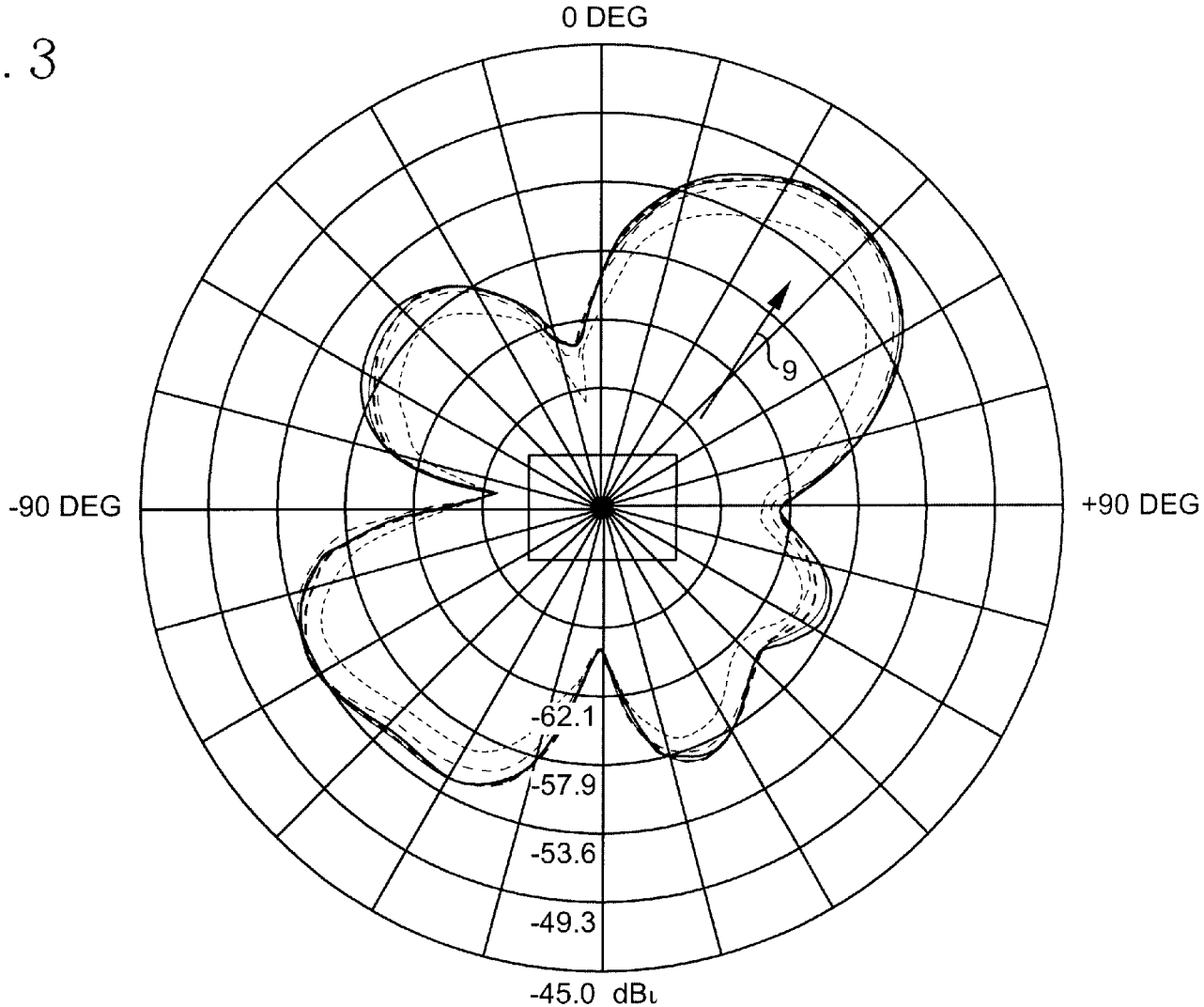
FIG. 3 shows the azimuth antenna pattern of the same practical embodiment of the antenna system for vertical polarization over one range of frequencies. The plane of rotation is that of the paper.

Referring to FIG. 3, the vertically polarized azimuth pattern of a practical embodiment of the antenna of the present invention for certain frequencies in the range of 2.4–2.5 GHz is shown. Reference dipole gain of +2 dBi is at the −51 dBi level on this plot, thus gain of the present antenna is +2 dBi nominal in direction 9 at angle 68 degrees. Front-to-back ratio is seen to be 5 dB nominal. The image at the center of the polar plot is an icon representing the parasitic element located above the radiating portion of the driven element.

Figure 4:
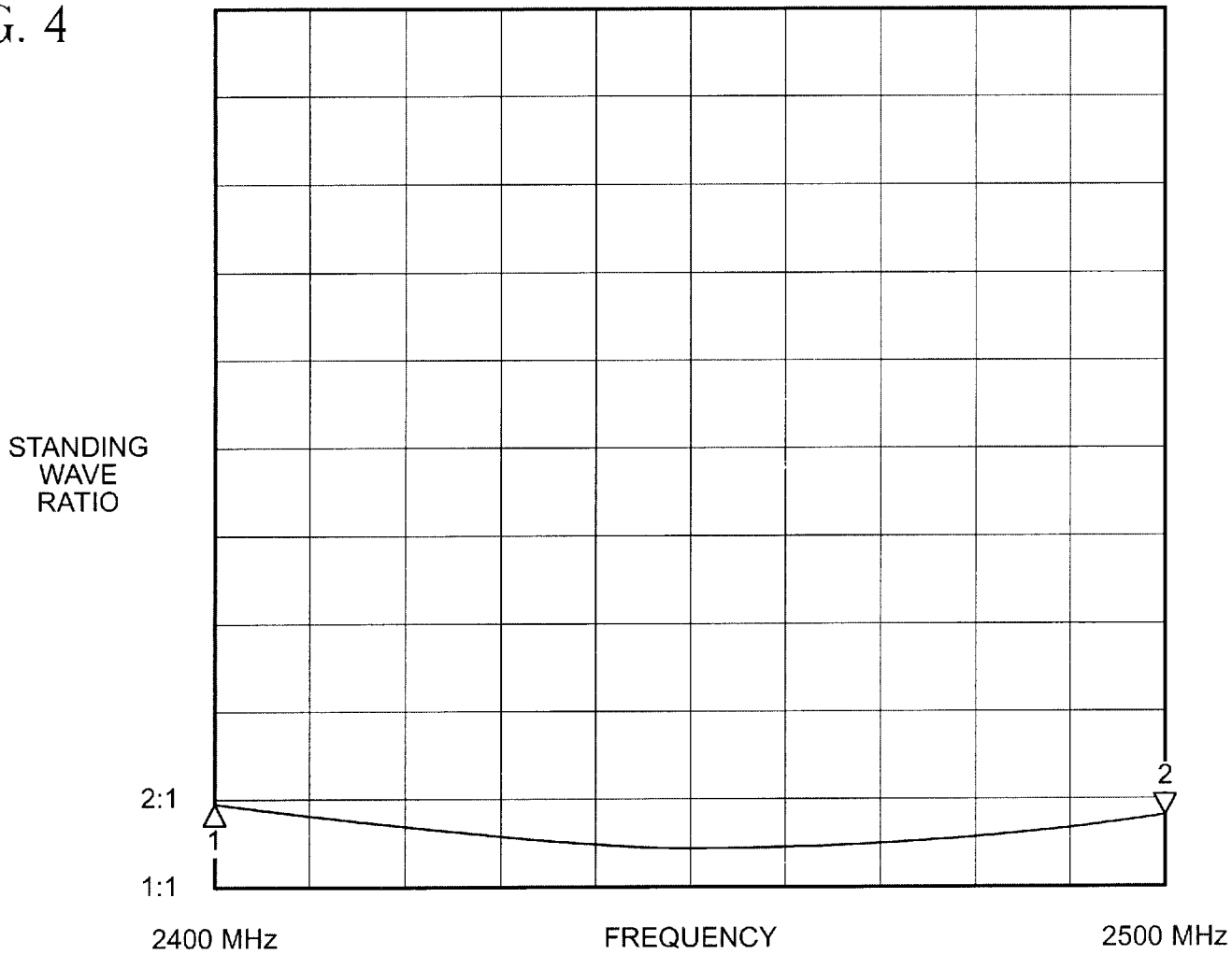
FIG. 4 shows the VSWR plot vs frequency for the same practical embodiment of the antenna whose patterns are shown in FIGS. 2 and 3 above.

Referring to FIG. 4, the VSWR of the antenna whose patterns are shown in FIGS. 2 and 3 above is shown, and is seen to be 2:1 maximum (1.97 at marker 1, 1.8 at marker 2), which is an acceptable value.

Figure 5:
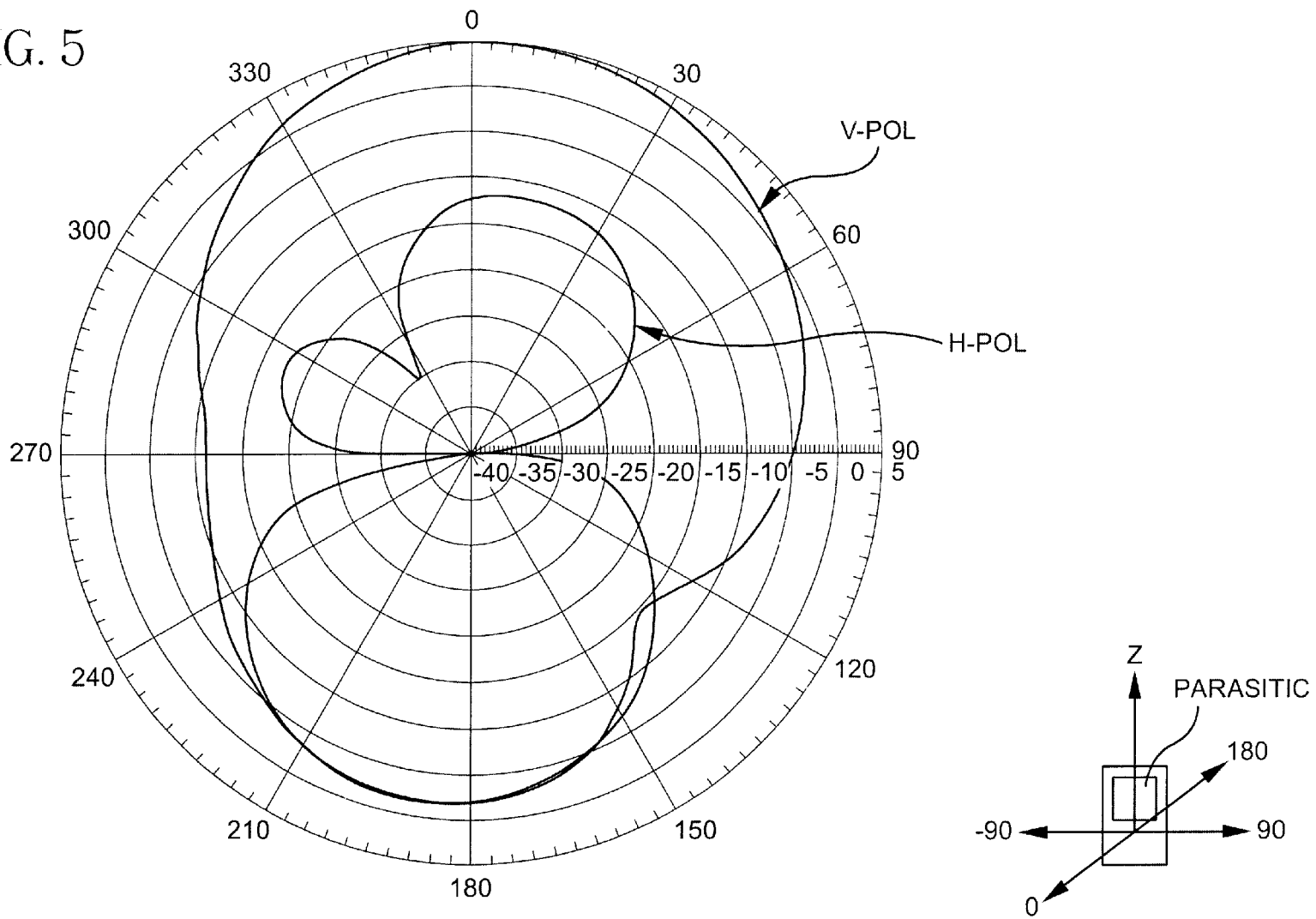
FIG. 5 shows azimuth antenna patterns of the same practical embodiment of the antenna system for vertical and horizontal polarizations over one range of frequencies. The plane of rotation is along the z-direction.

FIG. 5 shows the radiation pattern of a practical embodiment of the antenna of the present invention. The vertical and horizontal polarization gain levels are seen to be very nearly equal over the angular sector of 141 to 219 degrees. The legend shows the orientation of the parasitic element lying over the radiating portion of the asymmetric dipole driven element.

I claim:

1. A hand held wireless communications device having a signal line and a ground plane, said device comprising an enclosure for said device, an antenna, at least partly within said enclosure, said antenna operating within a frequency band and including a driven element and a parasitic director element, said driven element being an asymmetric dipole formed from a plurality of conductive traces disposed upon a first dielectric substrate, including a first conductive resonator trace and a second conductive radiating trace, said first conductive resonator trace having an elongated form and having electrical length of approximately one-quarter of a wavelength within said frequency band, said first conductive resonator trace being coupled to both the signal line and the ground plane of the wireless communications device, said second conductive radiating trace being coupled to the ground plane, said parasitic director element being a conductor disposed upon a second dielectric substrate having a length dimension of approximately a half of the wavelength, said parasitic director element spaced from said driven element in a direction generally perpendicular to the first dielectric substrate by 0.01 to 0.1 wavelength within said frequency band.

2. The device of claim 1 wherein at least said parasitic director element and said second conductive radiating trace of the asymmetric dipole are within said enclosure.

3. The device of claim 2 wherein said parasitic director element is on the inside surface of said enclosure.

4. The device of claim 2 wherein said resonator trace of said asymmetric dipole is within said enclosure.

5. The device of claim 2 wherein said resonator trace of said asymmetric dipole is within said enclosure and has a substantially planar configuration.

6. The device of claim 5 wherein said resonator trace also has a meandering or serpentine configuration.

7. The device of claim 6 wherein said resonator trace is formed by conductive printed wiring traces on a printed wiring board.

8. The device of claim 7 wherein said hand held wireless communications device has a printed wiring board within said enclosure, said printed wiring board having conductive ground traces, said radiator trace comprises the ground traces of said printed wiring board.

9. The device of claim 6 wherein said resonator trace includes a metal stamping.

10. The device of claim 2 wherein said resonator trace is mounted externally on said enclosure.

11. The device of claim 2 wherein at least said radiator trace of the asymmetric dipole is within said enclosure and said parasitic director element is on the external surface of said enclosure.

12. The device of claim 11 wherein said resonator trace of said asymmetric dipole is within said enclosure.

13. The device of claim 11 wherein said resonator trace of said asymmetric dipole is within said enclosure and has a substantially planar configuration.

14. The device of claim 13 wherein said resonator trace also has a meandering or serpentine configuration.

15. The device of claim 14 wherein said resonator trace is formed by conductive printed wiring traces on a printed wiring board.

16. The device of claim 15 wherein said hand held wireless communications device has a printed wiring board within said enclosure, said printed wiring board having conductive ground traces, said radiator trace comprises the ground traces of said printed wiring board.

17. The device of claim 14 wherein said resonator trace includes a metal stamping.

18. The device of claim 11 wherein said resonator trace is mounted externally on said enclosure.

* * * * *